US009816499B2

(12) United States Patent
Ishikawa et al.

(10) Patent No.: US 9,816,499 B2
(45) Date of Patent: Nov. 14, 2017

(54) ELECTRIC COMPRESSOR WITH BLOCKING PLATE

(75) Inventors: Masayuki Ishikawa, Tokyo (JP); Takayuki Hagita, Tokyo (JP); Yuki Ichise, Tokyo (JP); Takeshi Hirano, Tokyo (JP); Takayuki Watanabe, Tokyo (JP)

(73) Assignee: MITSUBISHI HEAVY INDUSTRIES AUTOMOTIVE THERMAL SYSTEMS CO., LTD., Kiyosu-shi (JP)

( * ) Notice: Subject to any disclaimer, the term of this patent is extended or adjusted under 35 U.S.C. 154(b) by 262 days.

(21) Appl. No.: 13/814,156

(22) PCT Filed: Jan. 26, 2012

(86) PCT No.: PCT/JP2012/051610

§ 371 (c)(1),
(2), (4) Date: Jul. 11, 2013

(87) PCT Pub. No.: WO2012/102322

PCT Pub. Date: Aug. 2, 2012

(65) Prior Publication Data

US 2013/0294951 A1 Nov. 7, 2013

(30) Foreign Application Priority Data

Jan. 28, 2011 (JP) ..... 2011-017090

(51) Int. Cl.

| | |
|---|---|
| ***F04B 39/12*** | (2006.01) |
| ***F04B 53/16*** | (2006.01) |
| ***F04B 35/04*** | (2006.01) |
| *F04C 18/02* | (2006.01) |
| *F04C 23/00* | (2006.01) |

(52) U.S. Cl.

CPC ..... *F04B 39/121* (2013.01); *F04B 35/04* (2013.01); *F04B 53/16* (2013.01);
(Continued)

(58) Field of Classification Search

CPC ..... F04C 2230/60; F04C 2230/603; F04C 2230/604; F04C 2240/30; F04C 2240/52;
(Continued)

(56) References Cited

U.S. PATENT DOCUMENTS 5,213,489 A * 5/1993 Kawahara et al. ..... 418/55.1
5,549,466 A 8/1996 Hod et al.
(Continued)

FOREIGN PATENT DOCUMENTS

JP 2538079 B2 9/1996
JP 10-299681 A 11/1998
(Continued)

OTHER PUBLICATIONS

Japanese Decision to Grant a Patent dated Jul. 1, 2014, issued in corresponding Japanese Patent Application No. 2011-017090 (3 pages), Explanation of Relevancy—"The Decision to Grant a Patent has been received".

(Continued)

*Primary Examiner* — Bryan Lettman
(74) *Attorney, Agent, or Firm* — Westerman, Hattori, Daniels & Adrian, LLP

(57) ABSTRACT

An electric compressor includes a compression unit that compresses a refrigerant, an electric motor that is coupled with the compression unit via a main shaft and a housing that accommodates the compression unit and the electric motor. The electric compressor further includes an end-side bearing holding part that is provided near an axial end of the housing closer to the electric motor and a rolling bearing that has an outer ring press-fitted into the end-side bearing holding part and an inner ring into which an end of the rotating shaft is press-fitted, and that supports the main shaft, in which an opening into which an assembly jig for supporting the rolling bearing when the main shaft is press-fitted into the
(Continued)

inner ring can be inserted and removed is provided in an end surface of the housing near the end-side bearing holding part.

3 Claims, 11 Drawing Sheets

(52) U.S. Cl.
CPC ..... *F04C 18/0215* (2013.01); *F04C 23/008* (2013.01); *F04C 2230/60* (2013.01); *F04C 2240/30* (2013.01); *Y10T 29/49236* (2015.01)

(58) Field of Classification Search
CPC .... F04C 2240/56; F04B 39/121; F04B 53/16; F04B 53/22; F04B 35/04; F04D 29/059; F04D 29/40
See application file for complete search history.

(56) References Cited

U.S. PATENT DOCUMENTS 5,564,186 A 10/1996 Hod et al.
7,364,416 B2 * 4/2008 Liang ..... F04C 27/005 417/310
7,475,678 B2 * 1/2009 Douyama ..... F02M 37/103 123/509
8,974,197 B2 * 3/2015 Vanbritson ..... F01C 21/02 417/410.3
2006/0181168 A1 * 8/2006 Hargraves et al. ..... 310/90
2010/0132186 A1 6/2010 Hargraves et al.

FOREIGN PATENT DOCUMENTS

JP 2002-188575 A 7/2002
JP 3605194 B2 12/2004
JP 2009-281280 A 12/2009
JP 2010-163977 A 7/2010
WO 2004/111458 A1 12/2004

OTHER PUBLICATIONS

International Search Report of PCT/JP2012/051610, mailing date of Apr. 10, 2012.
Written Opinion of PCT/JP2012/051610, mailing date of Apr. 10, 2012.
Extended (supplementary) European Search Report dated Apr. 18, 2017, issued in counterpart European Patent Application No. 12738848.6. (9 pages).

* cited by examiner

ELECTRIC COMPRESSOR WITH BLOCKING PLATE

TECHNICAL FIELD

The present invention relates to an electric compressor in which an electric motor and a compressor are coaxially integrated in a housing and that is suitable for use particularly in a vehicle air conditioning system, as well as an assembly method therefor.

BACKGROUND ART

Instead of a compressor that is driven via an electromagnetic clutch by an internal-combustion engine used for traveling, some air conditioning systems for vehicles that travel by means of the power of an internal-combustion engine use an electric compressor in order to improve the reduced drivability caused by engaging and disengaging the electromagnetic clutch.

Furthermore, in recent years, in addition to vehicles that travel by means of an internal-combustion engine, vehicles that travel by means of the power of an electric motor, such as electric vehicles, hybrid vehicles, and fuel-cell vehicles, have been rapidly developed and launched onto the market. Many air conditioning systems for such vehicles that travel by means of the power of an electric motor use an electric compressor, which is driven by an electric motor, as a compressor for compressing and supplying a refrigerant.

As such conventional electric compressors, as shown in FIGS. 11 and 12, hermetic electric compressors 100 and 200 in which an electric motor 12 and a scroll compression mechanism 11 are installed in a housing 2 and integrated on the same shaft 14 are employed. Like many other electric compressors, the electric compressors 100 and 200 shown in FIGS. 11 and 12 are each structured such that a compression-mechanism housing 3 accommodating the scroll compression mechanism 11 and an electric-motor housing 4 accommodating the electric motor 12 are joined with a bulkhead member 5 disposed therebetween.

In the electric compressor 100 used for a vehicle that travels by means of an internal-combustion engine, as shown in FIG. 11, the front end and the rear end of the main shaft 14 of the electric motor 12 are supported by a large-diameter main bearing 18 that is formed of a ball bearing press-fitted into the bulkhead member 5 and a small-diameter sub-bearing 19 that is provided at the back of the electric-motor housing 4.

A rotor 16 that constitutes the electric motor 12 is provided at an intermediate portion of the main shaft 14 so as to rotate integrally therewith. In general, the rotor 16 is shrink-fitted onto the main shaft 14. Furthermore, the front end of the main shaft 14 is inserted into the compression-mechanism housing 3 and is coupled with a rotary compression member 23 that constitutes the scroll compression mechanism 11 so as to drive the rotary compression member 23.

In a case of the thus-structured electric compressor 100, a thrust load imposed on the main shaft 14 is received by the main bearing 18, which is dual press-fitted. Specifically, an outer race 18*a* of the main bearing 18 is press-fitted into a main-bearing bore part 5*a* formed in the bulkhead member 5, from the scroll compression mechanism 11 side, and a main-bearing journal part 14*b* formed on the main shaft 14 is press-fitted into an inner race 18*b* of the main bearing 18 from the electric motor 12 side, thereby performing positioning. Here, the expressions "press-fitting from the electric motor 12 side" and "press-fitting from the scroll compression mechanism 11 side" mean that press-fitting is performed from either side of the bulkhead member 5 and from either side of the main bearing 18 but do not mean that press-fitting is performed inside the housing 2 of the electric compressor 100. In practice, each press-fitting is performed when the bulkhead member 5, the main bearing 18, and the main shaft 14 are outside the housing 2 of the electric compressor 100.

In the case of an electric compressor to be installed in a vehicle that travels by means of the power of an electric motor, as shown in FIG. 12, it is considered that a needle bearing is used as the main bearing 18 in order to reduce the weight, and a ball bearing, serving as the sub-bearing 19, is press-fitted to receive a thrust load imposed on the main shaft 14 (for example, PTL 1).

In PTL 1 or the electric compressor 200 shown in FIG. 12, the assembly order of the housing 2 main body, the main shaft 14, and the sub-bearing 19, which is formed of a ball bearing, is as follows. Specifically, first, the outer race 19*a* of the sub-bearing 19 is press-fitted into the sub-bearing bore part 4*c* provided in the housing 2 main body, from the scroll compression mechanism 11 side. Next, the sub-bearing journal part 14*c* of the main shaft 14 is press-fitted into the inner race 19*b* of the sub-bearing 19 from the scroll compression mechanism 11 side. At this time, it is necessary to use an assembly jig to support and press-fit the sub-bearing 19 from the rear end side of the main shaft 14 (the right side in FIG. 12).

CITATION LIST

Patent Literature

{PTL 1} Japanese Unexamined Patent Application, Publication No. 2010-163977
{PTL 2} Publication of Japanese Patent No. 2538079
{PTL 3} Japanese Unexamined Patent Application, Publication No. 2002-188575
{PTL 4} Publication of Japanese Patent No. 3605194

SUMMARY OF INVENTION

Technical Problem

In the case of the electric compressor 200 shown in FIG. 12, however, the electric-motor housing 4 is opened to the scroll compression mechanism 11, and its cross-sectional shape in the axial direction thereof is substantially an angular U-shape, as shown in FIG. 12. Thus, there is a problem in that, when the inner race 19*b* is press-fitted into the sub-bearing 19, the sub-bearing 19 cannot be supported by the assembly jig from the rear end side of the main shaft 14 due to a surface 4*f* of the electric-motor housing 4 closer to the rear end of the electric-motor housing 4, thus making it impossible to dual press-fit the sub-bearing 19, which is a ball bearing.

PTLs 2, 3, and 4 disclose that an opening for communicating with the outside is provided in a location in the electric-motor housing main body that faces the rear end of the main shaft; however, the invention described in PTL 2 has a structure in which a precompression is applied to the sub-bearing by a wave washer, and the thrust load imposed on the main shaft is not received by the sub-bearing. Furthermore, in the invention described in PTL 3, an opening provided in the electric-motor housing main body is a gas-suctioning suction port provided for a sub-bearing; thus, dual press-fitting of the ball bearing is not considered.

Furthermore, in the invention described in PTL 4, an opening is provided in the electric-motor housing main body in order to position a stator and a rotor when the rotor is magnetized; thus, dual press-fitting of the ball bearing is not considered.

The present invention has been made in view of such circumstances, and an object thereof is to provide an electric compressor and an assembly method therefor that allow attachment of the sub-bearing of the electric motor through dual press-fitting, thus achieving a reduction in weight and simplifying assembly.

Solution to Problem

In order to solve the above-described problems, the present invention employs the following solutions.

Specifically, according to a first aspect, the present invention provides an electric compressor including: a compression unit that compresses a refrigerant; an electric motor that is coupled with the compression unit via a rotating shaft; a housing that accommodates the compression unit and the electric motor; an end-side bearing holding part that is provided near an axial end of the housing closer to the electric motor; and a rolling bearing that has an outer ring that is press-fitted into the end-side bearing holding part and an inner ring into which an end of the rotating shaft is press-fitted, and that supports the rotating shaft, in which an opening into which an assembly jig for supporting the rolling bearing when the rotating shaft is press-fitted into the inner ring can be inserted and removed is provided in an end surface of the housing near the end-side bearing holding part.

The opening into which the assembly jig, which supports the rolling bearing when the rotating shaft is press-fitted into the inner ring of the rolling bearing, can be inserted and removed is provided in the end surface of the housing near the end-side bearing holding part, the housing accommodating the compression unit and the electric motor. Thus, it is possible to perform dual press-fitting, in which the outer ring of the rolling bearing is press-fitted into the end-side bearing holding part, and then the rotating shaft is press-fitted into the inner ring. Thus, a thrust load that occurs when the rotating shaft is driven can be received by the rolling bearing, which supports the end of the rotating shaft. Therefore, it is possible to achieve a reduction in the weight of the electric compressor, compared with conventional technologies.

In the above-described first aspect, a bolt may be screwed into the opening so as to block the opening.

The bolt is screwed into the opening, provided in the housing, to block the opening. Thus, the housing can be sealed. Therefore, it is possible to prevent the refrigerant compressed by the compression unit from leaking outside the housing.

In the above-described first aspect, a blocking plate may be provided so as to block the opening, with a sealing member interposed therebetween.

The blocking plate is provided in the opening, provided in the housing, to block the opening, with the sealing member interposed therebetween. Thus, the housing can be sealed. Therefore, it is possible to prevent the refrigerant compressed by the compression unit from leaking outside the housing.

According to a second aspect, the present invention provides an electric compressor including: a compression unit that compresses a refrigerant; an electric motor that is coupled with the compression unit via a rotating shaft; a housing that has a cylinder-shaped housing main body for accommodating the compression unit and the electric motor and a cover for blocking an end surface of the housing main body; an end-side bearing holding part that is provided between the housing main body and the cover; and a rolling bearing that has an outer ring that is press-fitted into the end-side bearing holding part and an inner ring into which an end of the rotating shaft is press-fitted, in which an opening into which an assembly jig for supporting the rolling bearing when the rotating shaft is press-fitted into the inner ring can be inserted and removed is provided in a surface of the end-side bearing holding part facing the cover.

In the surface of the end-side bearing holding part interposed between the housing main body, which accommodates the compression unit and the electric motor, and the cover, which is provided on the end surface of the housing main body, the opening into which the assembly jig, which supports the rolling bearing when the rotating shaft is press-fitted into the inner ring of the rolling bearing, can be inserted and removed is provided so as to face the cover. Thus, it is possible to perform dual press-fitting, in which the outer ring of the rolling bearing is press-fitted into the end-side bearing holding part, and the rotating shaft is press-fitted into the inner ring. Thus, the thrust load, which occurs when the rotating shaft is driven, can be received by the rolling bearing, which supports the end of the rotating shaft. Therefore, it is possible to achieve a reduction in the weight of the electric compressor, compared with conventional technologies.

Furthermore, the end-side bearing holding part is provided between the housing main body and the cover, thus simplifying the task of press-fitting the rolling bearing. Therefore, assembly of the electric compressor can be simplified.

In the above-described second aspect, the end surface of the housing main body closer to the cover may have a concave portion that is depressed in a direction opposite to the cover; and the end-side bearing holding part may be embedded in the concave portion.

The concave portion, which is depressed in the direction opposite to the cover, is provided in the end surface of the housing main body closer to the cover, and the end-side bearing holding part is embedded in the concave portion. Thus, in assembling the electric compressor, the end surface of the housing main body is sealed only by the cover. Therefore, by sealing only the gap between the end surface of the housing main body and the cover, the sealing performance (airtightness) of the electric compressor can be further improved.

In one of the above-described aspects, the electric compressor may further include: a bearing that supports the rotating shaft disposed between the compression unit and the electric motor; and an intermediate bearing holding part that supports the bearing, in which the intermediate bearing holding part is provided integrally with the housing or the housing main body.

The bearing for receiving the rotating shaft, disposed between the compression unit and the electric motor, is provided, and the intermediate bearing holding part for supporting the bearing is integrally provided in the housing or the housing main body. Thus, it is possible to shrink-fit the electric motor onto the rotating shaft from the cover side of the housing and to locate the glass terminal, which connects the electric motor and the inverter, near the cover. Thus, it is possible to reduce the number of fixing points. Therefore, the sealing performance (airtightness) and the earthquake resistance of the electric compressor can be improved.

According to a third aspect, the present invention provides an electric-compressor assembly method for an electric compressor that includes: a compression unit that compresses a refrigerant; an electric motor that is coupled with the compression unit via a rotating shaft; a housing that accommodates the compression unit and the electric motor; an end-side bearing holding part that is provided near an axial end of the housing closer to the electric motor; and a rolling bearing that has an outer ring that is supported by being press-fitted into the end-side bearing holding part and an inner ring into which an end of the rotating shaft is press-fitted, and that supports the rotating shaft, the assembly method including inserting and removing an assembly jig for supporting the rolling bearing from an opening provided in an end surface of the housing near the end-side bearing holding part, when the rotating shaft is press-fitted into the inner ring.

Advantageous Effects of Invention

As described above, according to the electric compressor and the assembly method therefor of the present invention, the opening into which the assembly jig, which supports the rolling bearing when the rotating shaft is press-fitted into the inner ring of the rolling bearing, can be inserted and removed is provided in the end surface of the housing near the end-side bearing holding part, the housing accommodating the compression unit and the electric motor. Thus, it is possible to perform dual press-fitting, in which the outer ring of the rolling bearing is press-fitted into the end-side bearing holding part, and then the rotating shaft is press-fitted into the inner ring. Thus, the thrust load, which occurs when the rotating shaft is driven, can be received by the rolling bearing, which supports the end of the rotating shaft. Therefore, it is possible to achieve a reduction in the weight of the electric compressor, compared with conventional technologies.

DESCRIPTION OF EMBODIMENTS

Figure 1:
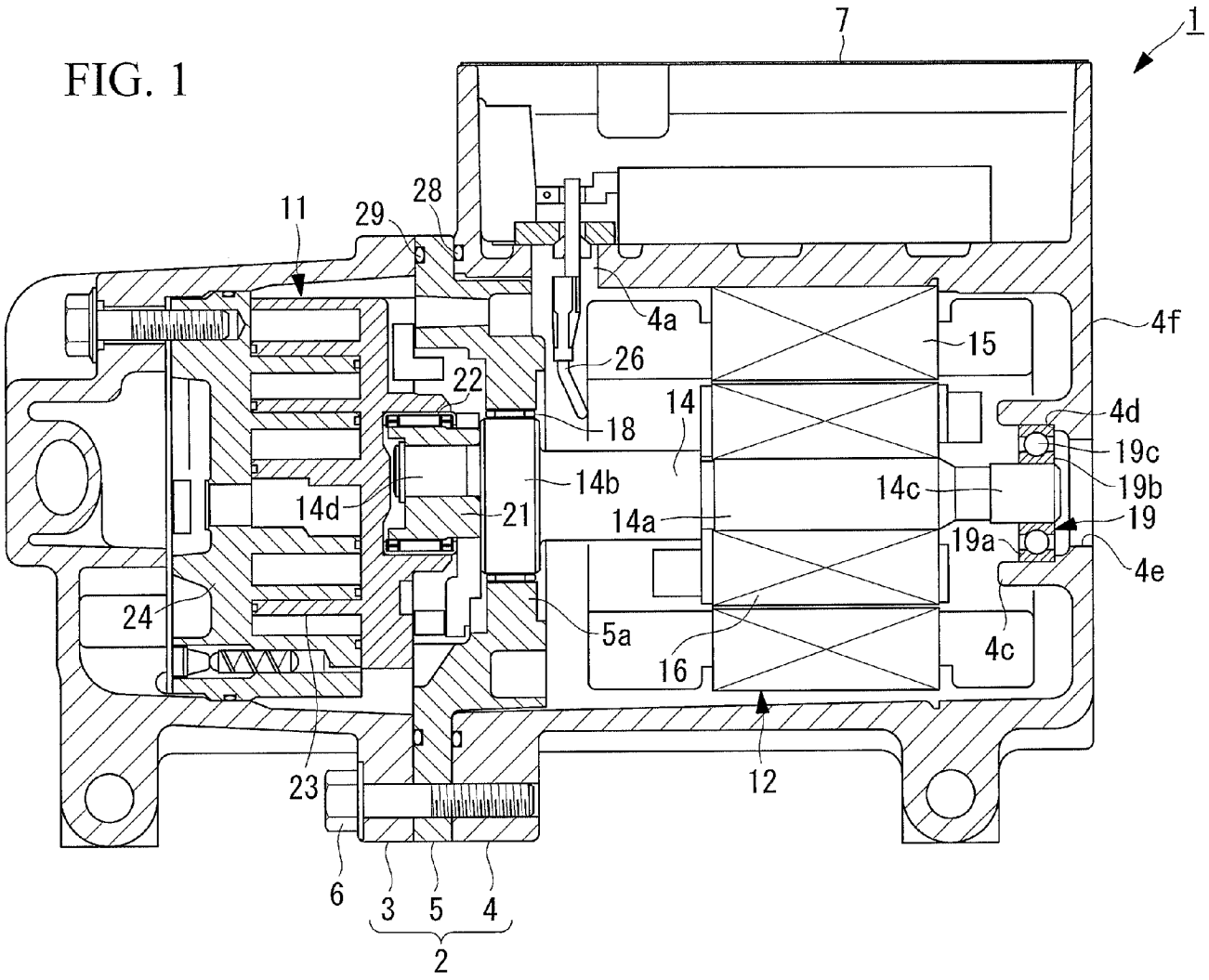
FIG. 1 is a longitudinal sectional view for explaining, in outline, the structure of an electric compressor according to a first embodiment of the present invention.
Figure 2:
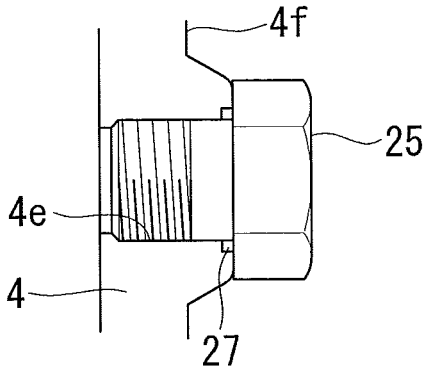
FIG. 2 is a partially-enlarged sectional view showing that an assembly-jig opening in an electric-motor housing shown in FIG. 1 is blocked by a blocking bolt.

An electric compressor and an assembly method therefor according to an embodiment of the present invention will be described below with reference to FIGS. 1 and 2. FIG. 1 is a longitudinal sectional view for explaining, in outline, the structure of the electric compressor according to this embodiment. FIG. 2 is a partially-enlarged sectional view showing that an assembly-jig opening shown in FIG. 1 is blocked by a blocking bolt.

An electric compressor 1 is a compressor used for a vehicle air conditioning system.

An aluminum alloy housing 2 forming an outer shell of the electric compressor 1 is structured such that a compression-mechanism housing 3 and an electric-motor housing 4 are fixed by a bolt 6 with a bulkhead member 5 interposed therebetween. The bulkhead member 5 is a member serving as a partition between the compression-mechanism housing 3 and the electric-motor housing 4 and is also a holding member for a main bearing 18, to be described later.

An inverter box 7 is integrally formed on the top of the electric-motor housing 4, and an inverter apparatus (not shown) is accommodated in the inverter box 7. A through channel 4*a* that passes through the electric-motor housing 4 in the vicinity of the bulkhead member 5 from a main shaft (rotating shaft) 14 toward the inverter box 7 in the radial direction of the main shaft 14 is provided at a place in the electric-motor housing 4 closer to the compression-mechanism housing 3. A glass terminal 26 connected to the inverter apparatus is accommodated in the through channel 4*a*.

A known scroll compression mechanism (compression unit) 11 is built into the compression-mechanism housing 3, which constitutes the housing 2, and an electric motor 12 is built into the electric-motor housing 4. The scroll compression mechanism 11 and the electric motor 12 are coaxially-coupled via the main shaft 14, thus being integrated. A stator 15 and a rotor 16 that constitute the electric motor 12 are built into the electric-motor housing 4. The stator 15 is fixed to the inner periphery of the electric-motor housing 4, and the rotor 16 is shrink-fitted onto a rotor press-fitting portion 14*a* that is formed at an intermediate portion of the main shaft 14 and is rotated integrally with the main shaft 14.

The main shaft 14 is rotatably supported by the main bearing 18, which is held by the bulkhead member 5, and a sub-bearing (rolling bearing) 19 that is press-fitted into a sub-bearing bore part (end-side bearing holding part) 4*c* provided near an inner end of the electric-motor housing 4.

A general needle bearing is used as the main bearing 18. A general radial ball bearing in which a plurality of ball-shaped rolling elements 19*c* are interposed between an outer race 19*a* and an inner race 19*b* is used as the sub-bearing 19.

The main bearing 18 is provided in a main-bearing bore part 5*a* formed in the bulkhead member 5 and supports a main-bearing journal part 14*b* that is formed by expanding, in a stepwise manner, the diameter of an end of the main shaft 14 closer to the scroll compression mechanism 11, the main shaft 14 connecting the scroll compression mechanism 11 and the electric motor 12.

The outer race 19*a* of the sub-bearing 19 is press-fitted into the sub-bearing bore part 4*c*, which is formed in the electric-motor housing 4, and the inner race 19*b* thereof is press-fitted onto a sub-bearing journal part 14*c* that is formed at an end opposite to the end where the main-bearing journal part 14*b* of the main shaft 14 is formed.

A crank pin 14*d* is eccentrically provided on the front surface of the main-bearing journal part 14*b* (the lower side in FIG. 1). The crank pin 14*d* is coupled, via a bushing 21 and a bearing 22, with an orbiting scroll member 23 that is accommodated in the compression-mechanism housing 3 near the distal end of the compression-mechanism housing 3, so as to be capable of eccentrically rotating. The orbiting scroll member 23 is fitted into a fixed scroll member 24 that is fixedly accommodated in the compression-mechanism housing 3 near the base end of the compression-mechanism housing 3 (the lower side in FIG. 1).

When the electric motor 12 is actuated to rotate the main shaft 14, this rotation is transferred to the crank pin 14*d*, the bushing 21, and the bearing 22 to eccentrically rotate the orbiting scroll member 23; therefore, air suction, compression, and exhaust actions repeatedly occur between the orbiting scroll member 23 and the fixed scroll member 24. Thus, a low-pressure refrigerant gas (refrigerant) is suctioned from a refrigerant suction port (not shown) provided in the electric-motor housing 4.

The refrigerant gas suctioned into the electric-motor housing 4 flows in the electric-motor housing 4 to cool the electric motor 12. Furthermore, the refrigerant gas that has cooled the electric motor 12 is suctioned into the scroll compression mechanism 11 where it is compressed to a high temperature and high pressure. The refrigerant gas whose temperature and pressure have been increased by the scroll compression mechanism 11 is discharged from a discharge port (not shown) provided at an end of the compression-mechanism housing 3.

Note that the electric motor 12 is controlled by the inverter apparatus accommodated in the inverter box 7, and the operating heat generated by the inverter apparatus is cooled by the refrigerant gas flowing in the electric-motor housing 4.

The sub-bearing journal part 14*c*, which is formed on the main shaft 14, is formed into a cylindrical shape such that it can be press-fitted into the inner race 19*b* of the sub-bearing 19 from the scroll compression mechanism 11 side.

Furthermore, the shoulder on the end of the sub-bearing journal part 14*c* is chamfered, thus making it easier to press-fit it into the inner race 19*b*. Note that the outer diameter of the sub-bearing journal part 14*c* is set smaller than the outer diameter of the rotor press-fitting portion 14*a*.

On the other hand, the sub-bearing bore part 4*c*, which is formed in the electric-motor housing 4, is formed into a cylinder-shaped borehole whose inner diameter is constant, such that the outer race 19*a* of the sub-bearing 19 can be press-fitted thereinto from the scroll compression mechanism 11 side.

The thus-structured sub-bearing bore part 4*c* is provided with a stepped part 4*d* in order to limit the movement of the outer race 19*a* of the sub-bearing 19 to be press-fitted thereinto, in the press-fitting direction (in the axial direction of the electric-motor housing 4). The outer race 19*a* that has been press-fitted from the scroll compression mechanism 11 side is brought into contact with the stepped part 4*d*, thereby limiting the movement of the outer race 19*a* in the axial direction.

Furthermore, the electric-motor housing 4 is provided with an assembly-jig opening (opening) 4*e* into which a substantially-cylinder-shaped assembly jig (not shown) for supporting the inner race 19*b* when the main shaft 14 is press-fitted into the inner race 19*b* of the sub-bearing 19 can be inserted and removed. The assembly-jig opening 4*e* is provided almost in the center of a surface 4*f* of the electric-motor housing 4 that faces the end of the main shaft 14.

As shown in FIG. 2, a blocking bolt (bolt) 25 that can block the assembly-jig opening 4*e* when it is screwed is provided in the assembly-jig opening 4*e*, which is provided in the electric-motor housing 4.

Next, the assembly method for the electric compressor 1, structured as described above, will be described with reference to FIGS. 1 and 2.

First, in a shrink fitting process, the rotor 16 is shrink-fitted onto the rotor press-fitting portion 14*a* of the main shaft 14. In the shrink fitting process, the rotor 16 is heated to make it expand, the main shaft 14 is cooled to make it shrink, the rotor press-fitting portion 14*a* of the main shaft 14 is inserted into a central hole (not shown) of the rotor 16, and then, these members 14 and 16 are both cooled, thus achieving shrink fitting.

Next, the stator 15 is fixed to the inner periphery of the electric-motor housing 4, and the inverter box 7 is installed on the top of the electric-motor housing 4. After the inverter box 7 is installed, assembly of the sub-bearing 19 and the electric-motor housing 4 is performed. Specifically, in a press fitting process of the outer race 19*a* of the sub-bearing 19, the outer race 19*a* of the sub-bearing 19 is press-fitted into the sub-bearing bore part 4*c* of the electric-motor housing 4 by using a pressing machine or the like, so as not to be inclined. The press-fitted outer race 19*a* is brought into contact with the stepped part 4*d*, provided on the sub-bearing bore part 4*c*, thus being positioned.

Next, in a press fitting process of the inner race 19*b* of the sub-bearing 19, the sub-bearing journal part 14*c* of the main shaft 14 is press-fitted into the inner race 19*b* of the sub-bearing 19, which is attached to the sub-bearing bore part 4*c*, from the scroll compression mechanism 11 side by using a pressing machine or the like.

At this time, in order to apply a pressing force for press fitting only to the inner race 19*b*, the assembly jig is inserted into the electric-motor housing 4 from the assembly-jig opening 4*e*, which is provided in the surface 4*f* of the electric-motor housing 4, to support the inner race 19*b* from the assembly-jig opening 4*e* side. By using the assembly jig to support the inner race 19*b* from the assembly-jig opening 4*e* side, as described above, the position of the inner race 19*b* with respect to the sub-bearing journal part 14*c* of the main shaft 14 is set in the press fitting process of the inner race 19*b*.

Note that the inner diameter of the assembly-jig opening 4*e*, provided in the electric-motor housing 4, is large enough for the assembly jig to be removed.

Furthermore, simultaneously with the press fitting process of the sub-bearing 19, the main bearing 18 is press-fitted into the main-bearing bore part 5*a* of the bulkhead member 5.

After the position of the inner race 19*b* with respect to the sub-bearing journal part 14*c* is set, the glass terminal 26 is inserted into the through channel 4*a*, which is provided in the electric-motor housing 4.

Then, the bulkhead member 5 is brought toward the main-bearing journal part 14*b* of the main shaft 14 accommodated in the electric-motor housing 4, so as to approach the electric-motor housing 4 from the scroll compression mechanism 11 side and is inserted such that the main-bearing bore part 5*a* of the bulkhead member 5 supports the main-bearing journal part 14*b*.

An O-ring 28 is provided between the bulkhead member 5 and the electric-motor housing 4, which are assembled as described above. This completes assembly of the bulkhead member 5, the main shaft 14, the rotor 16, the main bearing 18, and the sub-bearing 19.

Furthermore, as shown in FIG. 2, the blocking bolt 25 is screwed into the assembly-jig opening 4*e* of the electric-motor housing 4 from which the assembly jig that has supported the inner race 19*b* of the sub-bearing 19 is removed, with an O-ring 27 interposed between the surface 4*f* of the electric-motor housing 4 and the blocking bolt 25. After the blocking bolt 25 is screwed, the assembly-jig opening 4*e* is blocked.

After the assembly-jig opening 4*e* is blocked by the blocking bolt 25, as shown in FIG. 1, the bushing 21 is placed onto the crank pin 14*d* provided on the front surface side of the main shaft 14. The bushing 21 into which the crank pin 14*d* has been inserted is inserted into the bearing 22 press-fitted into the orbiting scroll member 23. Thus, the orbiting scroll member 23 and the main shaft 14 are coupled.

The fixed scroll member 24, which is fixedly accommodated in the compression-mechanism housing 3 near the base end of the compression-mechanism housing 3, is fitted into the orbiting scroll member 23, which is coupled with the main shaft 14, and an O-ring 29 is provided so as to be interposed between the compression-mechanism housing 3 and the bulkhead member 5.

Then, the compression-mechanism housing 3, the electric-motor housing 4, and the bulkhead member 5 are integrally fixed by the bolt 6, with the bulkhead member 5 interposed therebetween. Lastly, the inverter apparatus is accommodated in the inverter box 7, and the inverter apparatus is connected to the glass terminal 26, thus completing the assembly of the electric compressor 1.

The O-ring 27 provided between the surface 4*f* of the electric-motor housing 4 and the blocking bolt 25, the O-ring 28 provided between the electric-motor housing 4 and the bulkhead member 5, and the O-ring 29 provided between the compression-mechanism housing 3 and the bulkhead member 5, which have been assembled in this way, are each squeezed, thereby sealing the electric compressor 1 and preventing leakage of the refrigerant gas.

As described above, according to the electric compressor 1 and the assembly method therefor of this embodiment, the following advantageous effects are afforded.

Among the compression-mechanism housing 3, the electric-motor housing 4, and the bulkhead member 5, constituting the housing 2, in which the scroll compression mechanism (compression unit) 11 and the electric motor 12 are accommodated, the assembly-jig opening (opening) 4*e* into which the assembly jig (not shown), which supports the sub-bearing 19 when the main shaft (rotating shaft) 14 is press-fitted into the inner race (inner ring) 19*b* of the sub-bearing (rolling bearing) 19, can be inserted and removed is provided in the surface (end surface) 4*f* of the electric-motor housing 4 near the sub-bearing bore part (end-side bearing holding part) 4*c*. Thus, it is possible to perform dual press-fitting, in which the outer race (outer ring) 19*a* of the sub-bearing 19 is press-fitted into the sub-bearing bore part 4*c*, and then the main shaft 14 is press-fitted into the inner race 19*b*. Thus, a thrust load that occurs when the main shaft 14 is driven can be received by the sub-bearing 19, which supports the end of the main shaft 14. Therefore, it is possible to achieve a reduction in the weight of the electric compressor 1, compared with conventional technologies.

The blocking bolt (bolt) 25 is screwed into the assembly-jig opening 4*e*, provided in the electric-motor housing 4, to block the assembly-jig opening 4*e*. Thus, the electric-motor housing 4 can be sealed. Therefore, it is possible to prevent the refrigerant gas (refrigerant) compressed by the scroll compression mechanism 11 from leaking from the assembly-jig opening 4*e*.

Figure 3:
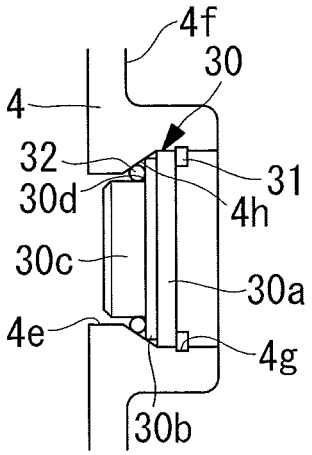
FIG. 3 is a partially-enlarged sectional view showing a modification for blocking the assembly-jig opening shown in FIG. 1 and showing that a blocking cover is provided in the assembly-jig opening.

Note that, in this embodiment, a description has been given of a case where the assembly-jig opening 4*e* is sealed by using the blocking bolt 25; however, the present invention is not limited thereto, and, as shown in FIG. 3, for example, a blocking cover may be provided in the assembly-jig opening.

FIG. 3 is a partially-enlarged sectional view showing that the blocking cover is provided in the assembly-jig opening in the electric-motor housing, as a modification of the present invention.

A blocking plate 30 for blocking the assembly-jig opening 4*e* is provided in the assembly-jig opening 4*e* of the electric-motor housing 4. The blocking plate 30 has a shape in which three substantially-disk-shaped parts having different inner diameters are stacked each other. The three substantially-disk-shaped parts having different inner diameters, which form the blocking plate 30, are disk parts 30*a*, 30*b*, and 30*c* whose outer diameters are reduced in this order from the surface 4*f* of the electric-motor housing 4 toward the inside of the electric-motor housing 4.

An engaging concave groove 4*g* where a snap ring (retaining ring) 31, to be described later, is engaged is provided at a portion of the inner wall of the assembly-jig opening 4*e*. Furthermore, a tapered part 4*h* is provided at a portion of the inner wall of the assembly-jig opening 4*e* so as to be able to support an O-ring (sealing member) 32, to be described later, with the blocking plate 30 when the blocking plate 30 is fixed in the assembly-jig opening 4*e*.

The snap ring 31 has a ring shape, and, by being engaged with the engaging concave groove 4*g*, it supports the disc part 30*a* of the blocking plate 30 provided in the assembly-jig opening 4*e*, from the surface 4*f* side of the electric-motor housing 4 (the right side in FIG. 3) to prevent the blocking plate 30 from coming off in the axial direction of the electric-motor housing 4.

The O-ring 32 prevents the refrigerant gas (refrigerant) in the electric compressor (not shown) from leaking from a gap between the tapered part 4*h*, provided on the inner wall of the assembly-jig opening 4*e*, and the blocking plate 30.

A method of blocking the assembly-jig opening 4*e* by using the blocking plate 30 will be described with reference to FIG. 3.

The O-ring 32 is provided at a corner 30*d* formed by the disc part 30*c*, having the smallest diameter among the three substantially-disk-shaped parts forming the blocking plate 30, and the disc part 30*b*, having an intermediate diameter, and the blocking plate 30 is inserted into the assembly-jig opening 4*e* from the surface 4*f* side such that the disc part 30*a*, having the largest diameter among the three substantially-disk-shaped parts forming the blocking plate 30, is located closer to the surface 4*f* of the electric-motor housing 4.

Then, the snap ring 31 is inserted into the assembly-jig opening 4*e* from the surface 4*f* side of the electric-motor housing 4 and is engaged with the engaging concave groove 4*g*. Thus, the movement of the blocking plate 30 in the assembly-jig opening 4*e* in the axial direction of the electric-motor housing 4 is limited, and the O-ring 32 provided between the tapered part 4*h* of the assembly-jig opening 4*e* and the corner 30*d* of the blocking plate 30 seals the assembly-jig opening 4*e*.

As described above, according to the electric compressor (not shown) and the assembly method therefor of the modification of this embodiment, the following advantageous effects are afforded.

The blocking plate 30 is provided in the assembly-jig opening (opening) 4*e*, provided in the electric-motor housing 4, which constitutes the housing (not shown), via the O-ring (sealing member) 32 to block the assembly-jig opening (opening) 4*e*. Thus, the housing for the electric compressor (not shown) can be sealed. Therefore, it is possible to prevent the refrigerant gas (refrigerant) compressed by the scroll compression mechanism (compression unit) (not shown) from leaking from the assembly-jig opening 4*e*.

Second Embodiment

An electric compressor and an assembly method therefor of this embodiment differ from those of the first embodiment in that the sub-bearing bore part is provided as a separate part from the electric-motor housing, and are identical in the other points. Therefore, identical reference symbols are assigned to the identical structures and assembly method, and a description thereof will be omitted.

Figure 4:
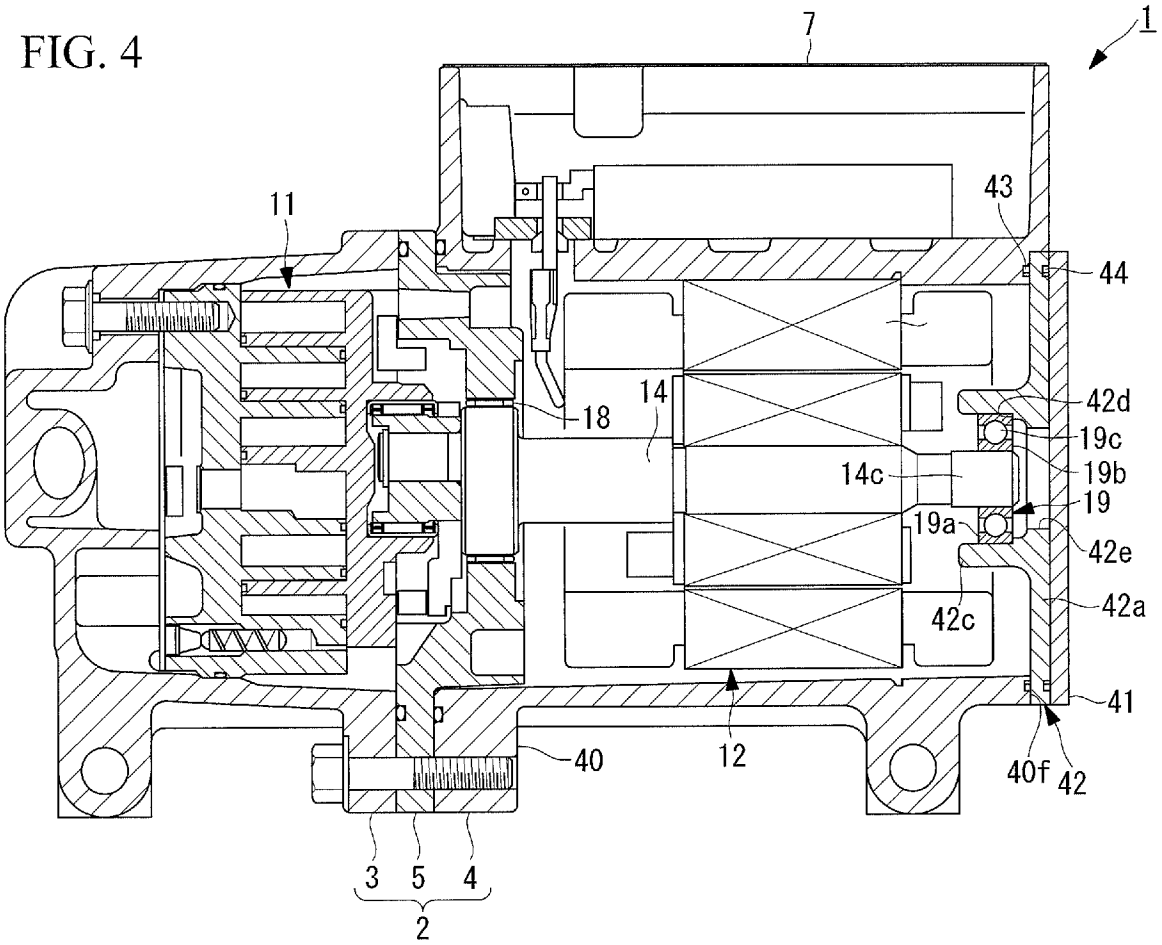
FIG. 4 is a longitudinal sectional view for explaining, in outline, the structure of an electric compressor according to a second embodiment of the present invention.

FIG. 4 is a longitudinal sectional view for explaining, in outline, the structure of the electric compressor of a second embodiment of the present invention.

The electric-motor housing 4 has a cylinder-shaped electric-motor housing main body (housing main body) 40 in which the electric motor 12 is accommodated and a cover 41 that blocks an end of the electric-motor housing main body 40 closer to the electric motor 12. A sub-bearing holding member (end-side bearing holding part) 42 is provided between the electric-motor housing main body 40 and the cover 41.

The sub-bearing holding member 42 has a flange part (surface) 42*a* that has an outer diameter almost the same as the outer diameters of the electric-motor housing main body 40 and the cover 41 and that is provided so as to face the cover 41 and a sub-bearing bore part 42*c* that protrudes from the flange part 42*a* toward the scroll compression mechanism (compression unit) 11.

In the thus-formed sub-bearing bore part 42*c*, a stepped part 42*d* is provided to limit the movement of the outer race (outer ring) 19*a* of the sub-bearing (rolling bearing) 19, which is press-fitted, in the press-fitting direction. The outer race 19*a* press-fitted from the scroll compression mechanism 11 side is brought into contact with the stepped part 42*d*, thereby limiting the movement of the outer race 19*a* in the axial direction.

Furthermore, an assembly-jig opening (opening) 42*e* into which a substantially-cylinder-shaped assembly jig (not shown) for supporting the inner race 19*b* when the main shaft 14 is press-fitted into the inner race 19*b* of the sub-bearing 19 can be inserted and removed is provided almost in the center of the flange part 42*a*, constituting the sub-bearing holding member 42.

In the assembly method for the thus-structured electric compressor 1, as in the first embodiment, the shrink fitting process and installation of the stator 15 and the inverter box 7 on the electric-motor housing 4 are performed.

Next, assembly of the sub-bearing 19 and the sub-bearing holding member 42 is performed. Specifically, in the press fitting process of the outer race 19*a* of the sub-bearing 19, the outer race 19*a* of the sub-bearing 19 is press-fitted into the sub-bearing bore part 42*c* of the sub-bearing holding member 42 by using a pressing machine or the like, so as not to be inclined. The outer race 19*a* press-fitted thereinto is brought into contact with the stepped part 42*d*, provided on the sub-bearing bore part 42*c*, thus being positioned.

Next, in the press fitting process of the inner race 19*b* of the sub-bearing 19, the sub-bearing journal part 14*c* of the main shaft (rotating shaft) 14 is press-fitted into the inner race 19*b* of the sub-bearing 19 attached to the sub-bearing bore part 42*c* of the sub-bearing holding member 42, from the scroll compression mechanism 11 side by using a pressing machine or the like.

At this time, in order to apply a pressing force for press fitting only to the inner race 19*b*, the substantially-cylinder-shaped assembly jig (not shown) is inserted from the assembly-jig opening 42*e*, which is provided in the flange part 42*a* of the sub-bearing holding member 42, to support the inner race 19*b* from the assembly-jig opening 42*e* side. By using the assembly jig to support the inner race 19*b* from the assembly-jig opening 42*e* side, in this way, the position of the inner race 19*b* with respect to the sub-bearing journal part 14*c* of the main shaft 14 is set in the press fitting process of the inner race 19*b*.

Note that the inner diameter of the assembly-jig opening 42*e*, provided in the flange part 42*a* of the sub-bearing holding member 42, is large enough for the assembly jig to be inserted and removed.

After the press fitting process of the inner race 19*b*, the assembly jig is removed, and the main shaft 14 is inserted into the electric-motor housing main body 40 from the cover 41 side of the electric-motor housing 4 such that the main shaft 14 to which the sub-bearing holding member 42 is connected is accommodated in the electric-motor housing main body 40.

After the main shaft 14 is inserted into the electric-motor housing main body 40, an O-ring 43 is provided between an end surface 40*f* of the electric-motor housing main body 40 closer to the cover 41 and the flange part 42*a* of the sub-bearing holding member 42. Then, the cover 41 is fixed to the electric-motor housing main body 40 from the flange part 42*a* side of the sub-bearing holding member 42 by a bolt (not shown). At this time, an O-ring 44 is provided between the cover 41 and the flange part 42*a* to seal the gap between the cover 41 and the flange part 42*a*.

As described above, according to the electric compressor 1 and the assembly method therefor of this embodiment, the following advantageous effects are afforded.

In the sub-bearing holding member (end-side bearing holding member) 42 interposed between the electric-motor housing main body (housing main body) 40 of the electric-motor housing 4, which constitutes the housing 2, in which the scroll compression mechanism (compression unit) 11 and the electric motor 12 are accommodated, and the cover 41, which is provided at the end of the electric-motor housing main body 40, the assembly-jig opening (opening) 42*e*, into which the assembly jig (not shown) for supporting the sub-bearing 19 when the main shaft (rotating shaft) 14 is press-fitted into the inner race (inner ring) 19*b* of the sub-bearing (rolling bearing) 19 can be inserted and removed, is provided in the flange part (surface) 42*a*, which faces the cover 41. Thus, it is possible to perform dual press-fitting, in which the outer race (outer ring) 19*a* of the sub-bearing 19 is press-fitted into the sub-bearing holding member 42, and the main shaft 14 is press-fitted into the inner race 19*b*. Thus, the thrust load, which occurs when the main shaft 14 is driven, can be received by the sub-bearing 19, which supports the end of the main shaft 14. Therefore, it is possible to achieve a reduction in the weight of the electric compressor 1, compared with conventional technologies.

Furthermore, the sub-bearing holding member 42 is provided between the electric-motor housing main body 40 and the cover 41, thus simplifying the task of press-fitting the sub-bearing 19. Therefore, assembly of the electric compressor 1 can be simplified.

Third Embodiment

An electric compressor and an assembly method therefor of this embodiment differ from those of the second embodiment in that the sub-bearing holding member is embedded in the end surface of the electric-motor housing main body, and are identical in the other points. Therefore, identical reference symbols are assigned to the identical structures and assembly method, and a description thereof will be omitted.

Figure 5:
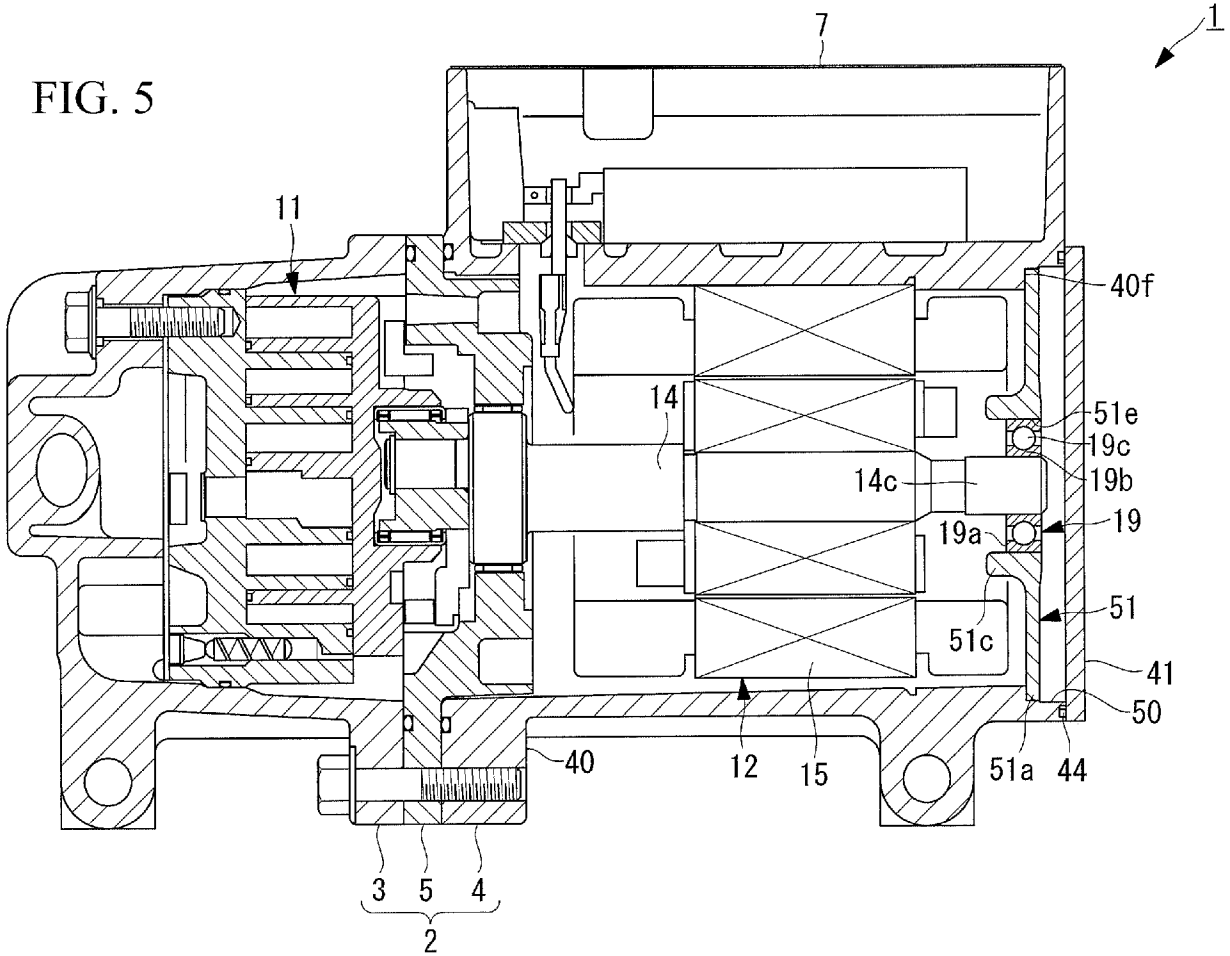
FIG. 5 is a longitudinal sectional view for explaining, in outline, the structure of an electric compressor according to a third embodiment of the present invention.

FIG. 5 is a longitudinal sectional view for explaining, in outline, the structure of the electric compressor of a third embodiment of the present invention.

In the end surface 40*f* of the electric-motor housing main body 40 closer to the cover 41, a concave portion 50 that is depressed in the direction opposite to the cover 41 (toward the left side in FIG. 5, toward the scroll compression mechanism (compression unit) 11) is provided. The concave portion 50 has almost the same inner diameter as the outer diameter of a sub-bearing holding member (end-side bearing holding member) 51, and a flange part (surface) 51*a* of the sub-bearing holding member 51 can be embedded in the concave portion 50.

The sub-bearing holding member 51 has the flange part 51*a* and a sub-bearing bore part 51*c* that protrudes from an almost center portion of the flange part 51*a* toward the scroll compression mechanism 11. The outer diameter of the flange part 51*a* is almost the same as the inner diameter of the concave portion 50 provided in the end surface 40*f* of the electric-motor housing main body 40, and the thickness of the flange part 51*a* (the thickness of the electric-motor housing main body 40 in the axial direction) is less than the depth of the concave portion 50 depressed toward the scroll compression mechanism 11. Furthermore, the flange part 51*a* has, at the center thereof, an opening 51*e* that is almost the same as the outer diameter of the sub-bearing (rolling bearing) 19.

In the assembly method for the thus-structured electric compressor 1, after the shrink fitting process and installation of the stator 15 and the inverter box 7 on the electric-motor housing 4 are performed, as in the second embodiment, assembly of the sub-bearing 19 and the sub-bearing holding member 51 is performed. Specifically, in the press fitting process of the outer race (outer ring) 19*a* of the sub-bearing 19, the outer race 19*a* of the sub-bearing 19 is press-fitted into the sub-bearing bore part 51*c* of the sub-bearing holding member 51 by using a pressing machine or the like, so as not to be inclined. The outer race 19*a* press-fitted into the sub-bearing bore part 51*c* is press-fitted across the opening 51*e* and the sub-bearing bore part 51*c* of the flange part 51*a*, thus being positioned so as to be flush with the surface of the flange part 51*a* closer to the cover 41.

Next, in the press fitting process of the inner race (inner ring) 19*b* of the sub-bearing 19, the sub-bearing journal part 14*c* of the main shaft 14 is press-fitted into the inner race 19*b* of the sub-bearing 19 attached to the sub-bearing bore part 51*c* of the sub-bearing holding member 51, from the scroll compression mechanism 11 side by using a pressing machine or the like.

At this time, in order to apply a pressing force for press fitting only to the inner race 19*b*, the substantially-cylinder-shaped assembly jig (not shown) is used to support the inner race 19*b* from the cover 41 side. By using the assembly jig to support the inner race 19*b* from the cover 41 side, in this way, the position of the inner race 19*b* with respect to the sub-bearing journal part 14*c* of the main shaft 14 can be set so as to be flush with the surface of the flange part 51*a* closer to the cover 41, in the press fitting process of the inner race 19*b*.

After the press fitting process of the inner race 19*b*, the assembly jig is removed, and the main shaft 14 is inserted into the electric-motor housing main body 40 from the cover 41 side of the electric-motor housing main body 40 such that the main shaft 14 to which the sub-bearing holding member 51 is connected is accommodated in the electric-motor housing main body 40.

The main shaft 14 is inserted into the electric-motor housing main body 40, and the flange part 51*a* of the sub-bearing holding member 51 is embedded and accommodated in the concave portion 50 on the end surface 40*f* of the electric-motor housing main body 40 closer to the cover 41.

Then, the cover 41 is fixed to the electric-motor housing main body 40 from the flange part 51*a* side of the sub-bearing holding member 51 by a bolt (not shown). At this time, the O-ring 44 is provided between the cover 41 and the flange part 51*a* to seal the gap between the cover 41 and the flange part 51*a*.

As described above, according to the electric compressor 1 and the assembly method therefor of this embodiment, the following advantageous effects are afforded.

The concave portion 50, which is depressed in the direction opposite to the cover 41, is provided in the end surface 40*f* of the electric-motor housing main body (housing main body) 40 closer to the cover 41. The flange part 51*a* of the sub-bearing holding member (end-side bearing holding part) 51 is embedded in the concave portion 50. Thus, in assembling the electric compressor 1, the end surface 40*f* of the electric-motor housing main body 40 closer to the cover 41 is sealed only by the cover 41. Therefore, only the gap between the cover 41 and the end surface 40*f* of the electric-motor housing main body 40 closer to the cover 41 is sealed, thus improving the sealing performance (airtightness) of the electric compressor 1, compared with the second embodiment.

Fourth Embodiment

An electric compressor and an assembly method therefor of this embodiment differ from those of the second embodiment in that the bulkhead member and the electric-motor housing are integrated, and are identical in the other points. Therefore, identical reference symbols are assigned to the identical structures and assembly method, and a description thereof will be omitted.

Figure 6:
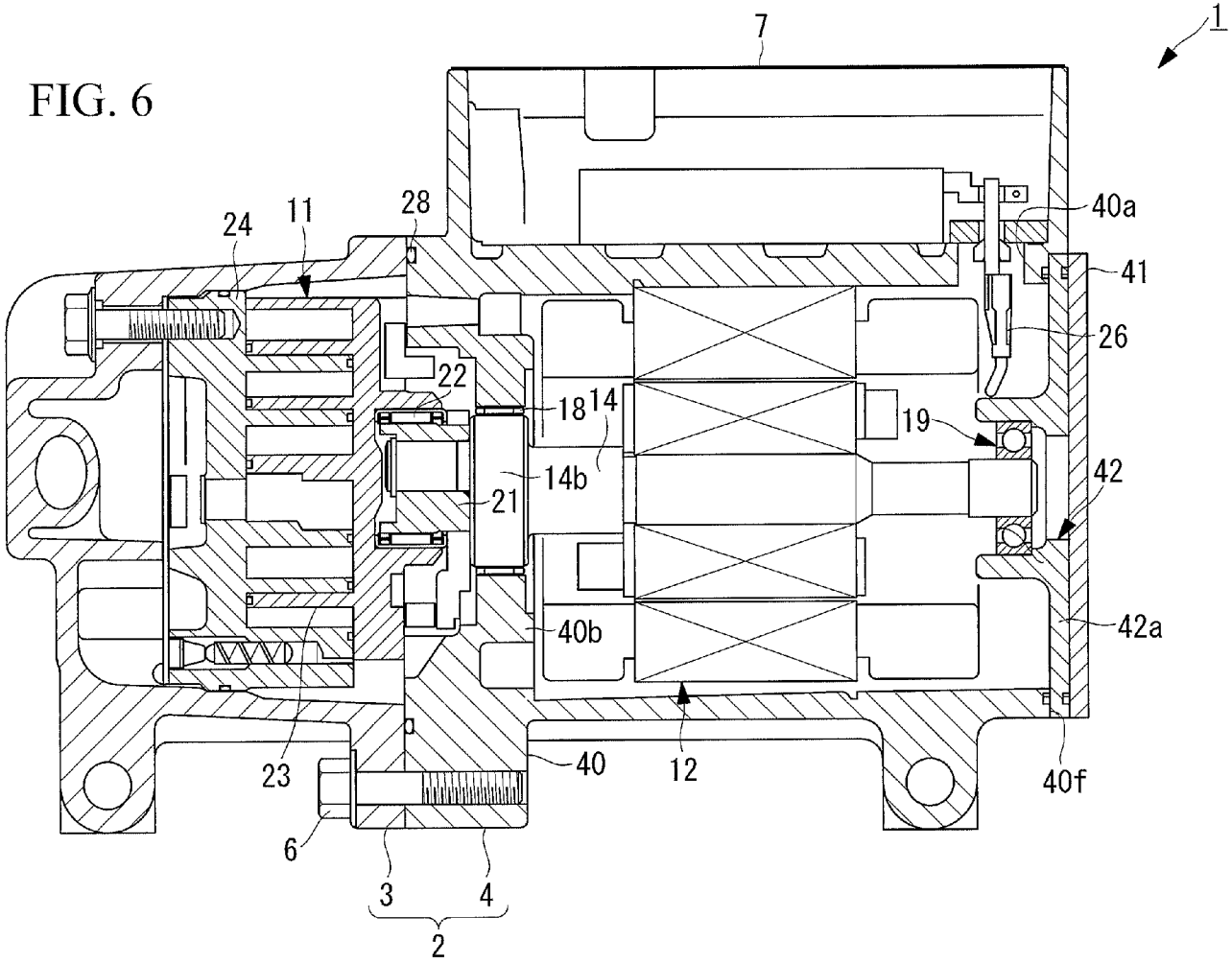
FIG. 6 is a longitudinal sectional view for explaining, in outline, the structure of an electric compressor according to a fourth embodiment of the present invention.

FIG. 6 is a longitudinal sectional view for explaining, in outline, the structure of the electric compressor of a fourth embodiment of the present invention.

The aluminum alloy housing 2, forming the outer shell of the electric compressor 1, is constituted by the compression-mechanism housing 3 and the electric-motor housing 4. The compression-mechanism housing 3 and the electric-motor housing 4 are fixed with the O-ring 28 interposed therebetween.

A through channel 40*a* that extends from the main shaft 14 toward the inverter box 7 in the radial direction of the main shaft (rotating shaft) 14 is provided near the end surface 40*f* of the electric-motor housing main body (housing main body) 40 of the electric-motor housing 4, and the glass terminal 26 is accommodated in the through channel 40*a*. Furthermore, a main-bearing bore part (intermediate bearing holding part) 40*b* that supports the main bearing (bearing) 18 is provided integrally with the electric-motor housing main body 40 in the electric-motor housing 4 closer to the compression-mechanism housing 3.

In the assembly method for the thus-structured electric compressor 1, the shrink fitting process and the assembly of the sub-bearing (rolling bearing) 19 and the sub-bearing holding member (end-side bearing holding member) 42 are performed, as in the second embodiment, and the main bearing 18 is press-fitted into the main-bearing bore part 40*b* provided in the electric-motor housing main body 40. Then, the glass terminal 26 is inserted into the through channel 40*a* of the electric-motor housing main body 40.

Next, the main shaft 14 is inserted into the electric-motor housing main body 40 from the cover 41 side of the electric-motor housing main body 40 such that the main shaft 14 to which the sub-bearing holding member 42 is connected is accommodated in the electric-motor housing main body 40.

The main-bearing journal part 14*b* of the main shaft 14 inserted into the electric-motor housing main body 40 is supported by the main bearing 18 press-fitted into the main-bearing bore part 40*b*. Furthermore, the main shaft 14 is supported by the main bearing 18, and the flange part (surface) 42*a* of the sub-bearing holding member 42 is brought into contact with the end surface 40*f* of the electric-motor housing main body 40. The cover 41 is fixed to the end surface 40*f* of the electric-motor housing main body 40, which is brought into contact with the flange part 42*a*, by a bolt (not shown).

The orbiting scroll member 23 is coupled with the crank pin 14*d* of the main shaft 14 that has been accommodated in the electric-motor housing 4 in this way, via the bushing 21 and the bearing 22. Then, the fixed scroll member 24, fixedly accommodated in the compression-mechanism housing 3 near the base end of the compression-mechanism housing 3, is fitted into the orbiting scroll member 23 with which the main shaft 14 is coupled, and the O-ring 28 is interposed between the compression-mechanism housing 3 and the electric-motor housing 4 and is fixed by the bolt 6. This completes assembly of the electric compressor 1.

As described above, according to the electric compressor 1 and the assembly method therefor of this embodiment, the following advantageous effects are afforded.

The main bearing (bearing) 18 for receiving the main shaft (rotating shaft) 14, which connects the scroll compression mechanism (compression unit) 11 and the electric motor 12, is provided, and the main-bearing bore part (intermediate bearing holding part) 40*b*, which supports the main bearing 18, is integrally provided in the electric-motor housing main body (housing main body) 40. Thus, it is possible to shrink-fit the electric motor 12 onto the main shaft 14 from the cover 41 side of the electric-motor housing main body 40 and to locate the glass terminal 26 in the electric-motor housing main body 40 closer to the cover 41. Thus, it is possible to reduce the number of places at which the housing 2, constituting the electric compressor 1, is fixed. Therefore, the sealing performance (airtightness) and the earthquake resistance of the electric compressor 1 can be improved.

Fifth Embodiment

An electric compressor and an assembly method therefor of this embodiment differ from those of the third embodiment in that the bulkhead member and the electric-motor housing are integrated, and are identical in the other points. Therefore, identical reference symbols are assigned to the identical structures, and a description thereof will be omitted.

Figure 7:
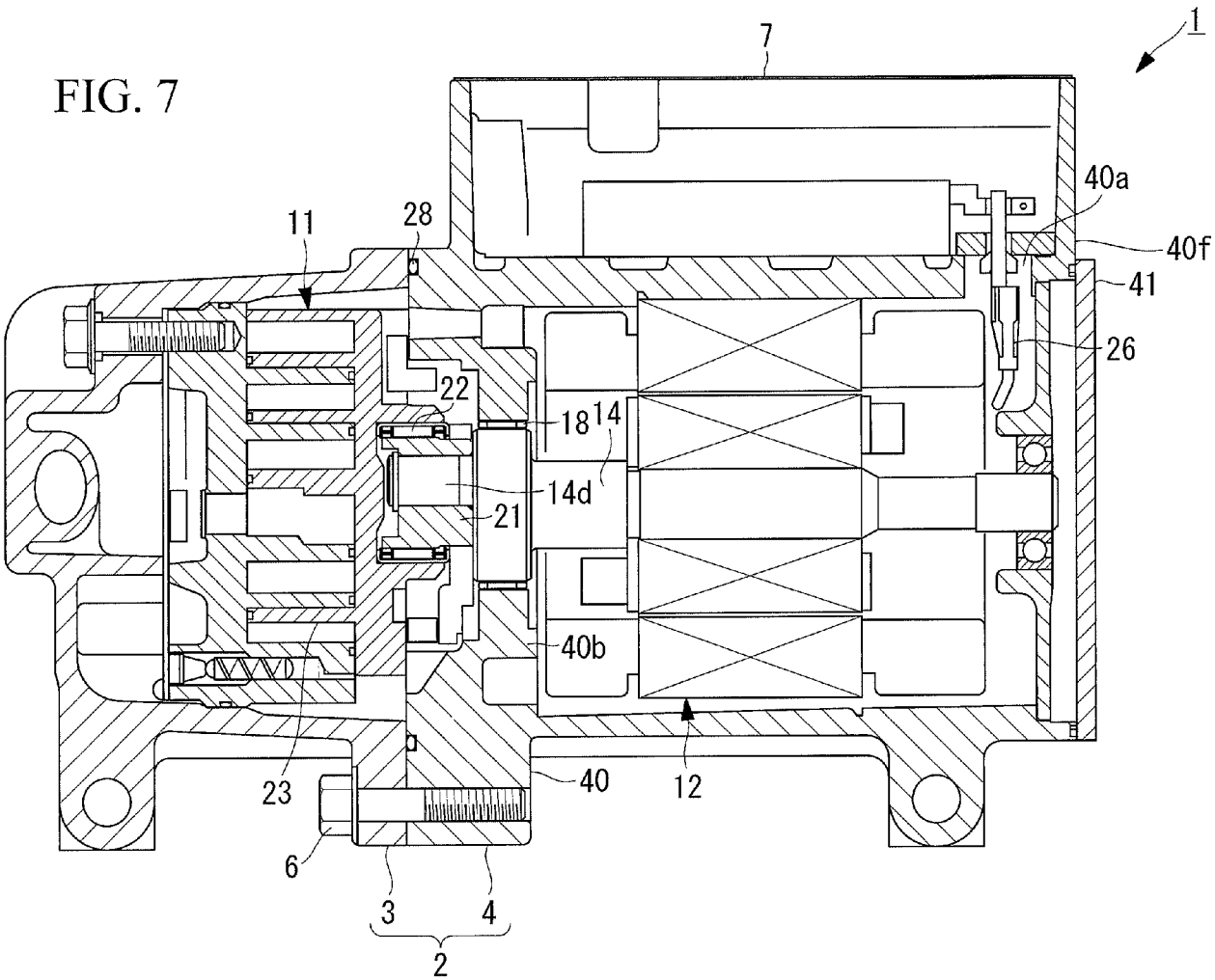
FIG. 7 is a longitudinal sectional view for explaining, in outline, the structure of an electric compressor according to a fifth embodiment of the present invention.
Figure 8:
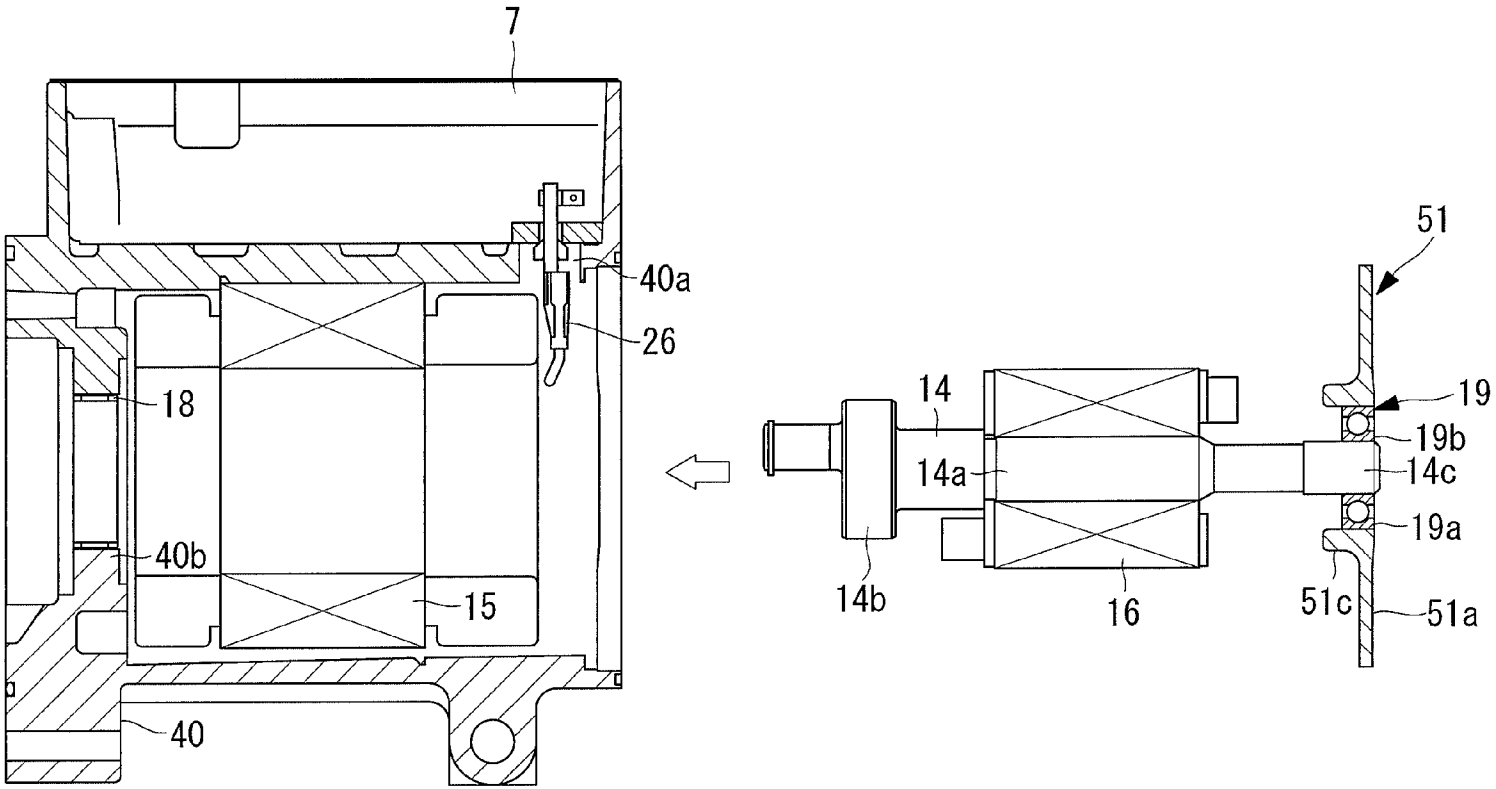
FIG. 8 is a view showing a procedure for assembly of the electric compressor according to the fifth embodiment of the present invention.
Figure 9:
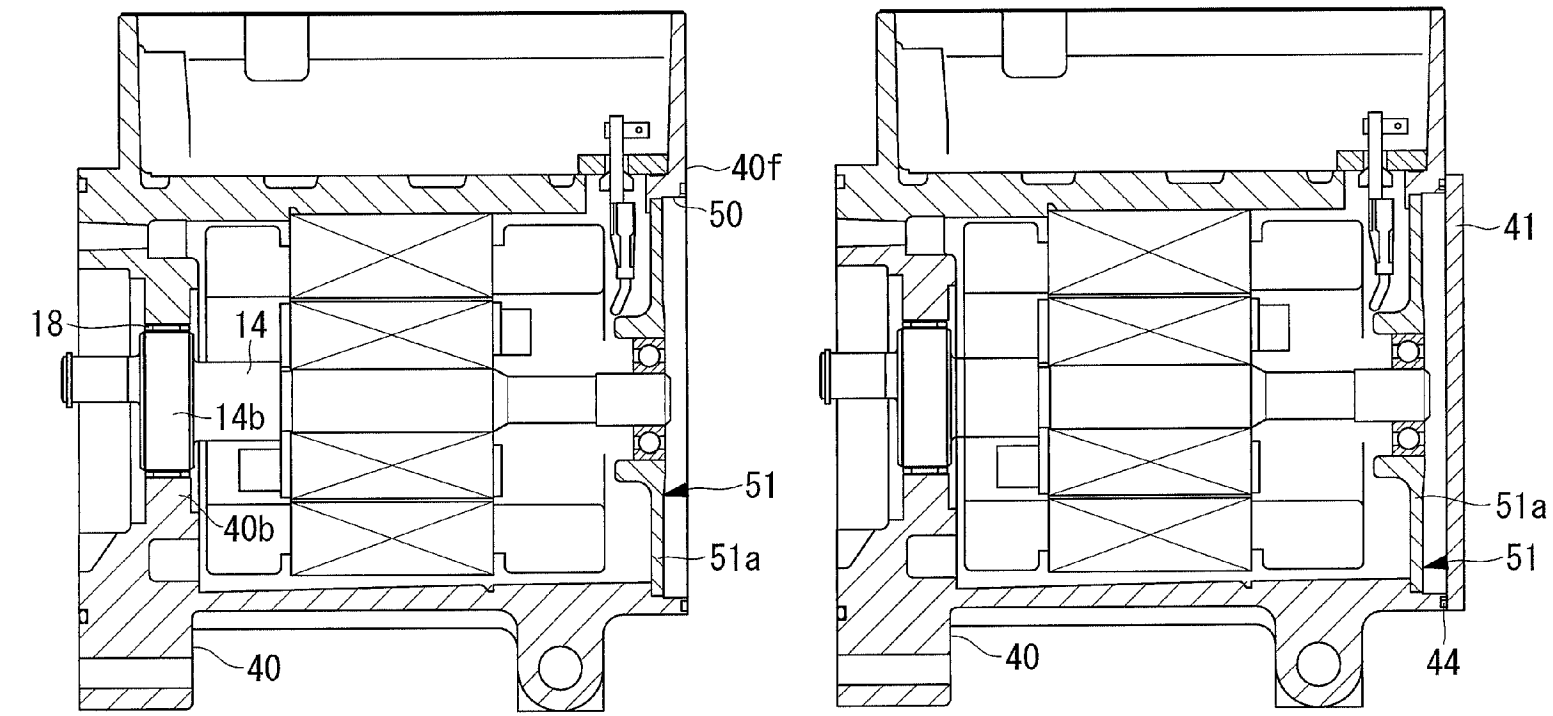
FIG. 9 is a view showing a continuation of the procedure for assembly of the electric compressor shown in FIG. 8.
Figure 10:
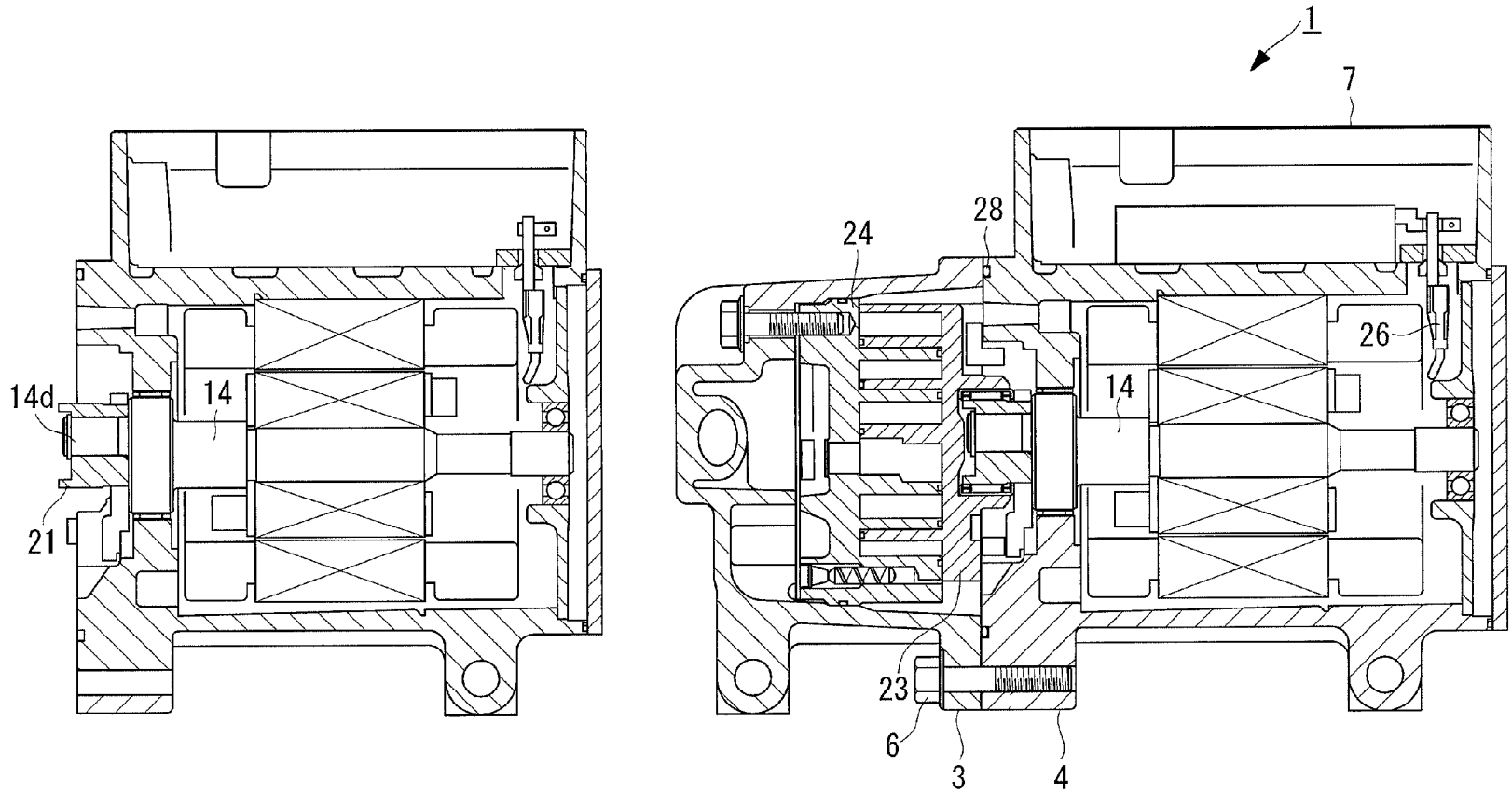
FIG. 10 is a view showing a continuation of the procedure for assembly of the electric compressor shown in FIG. 9.
Figure 11:
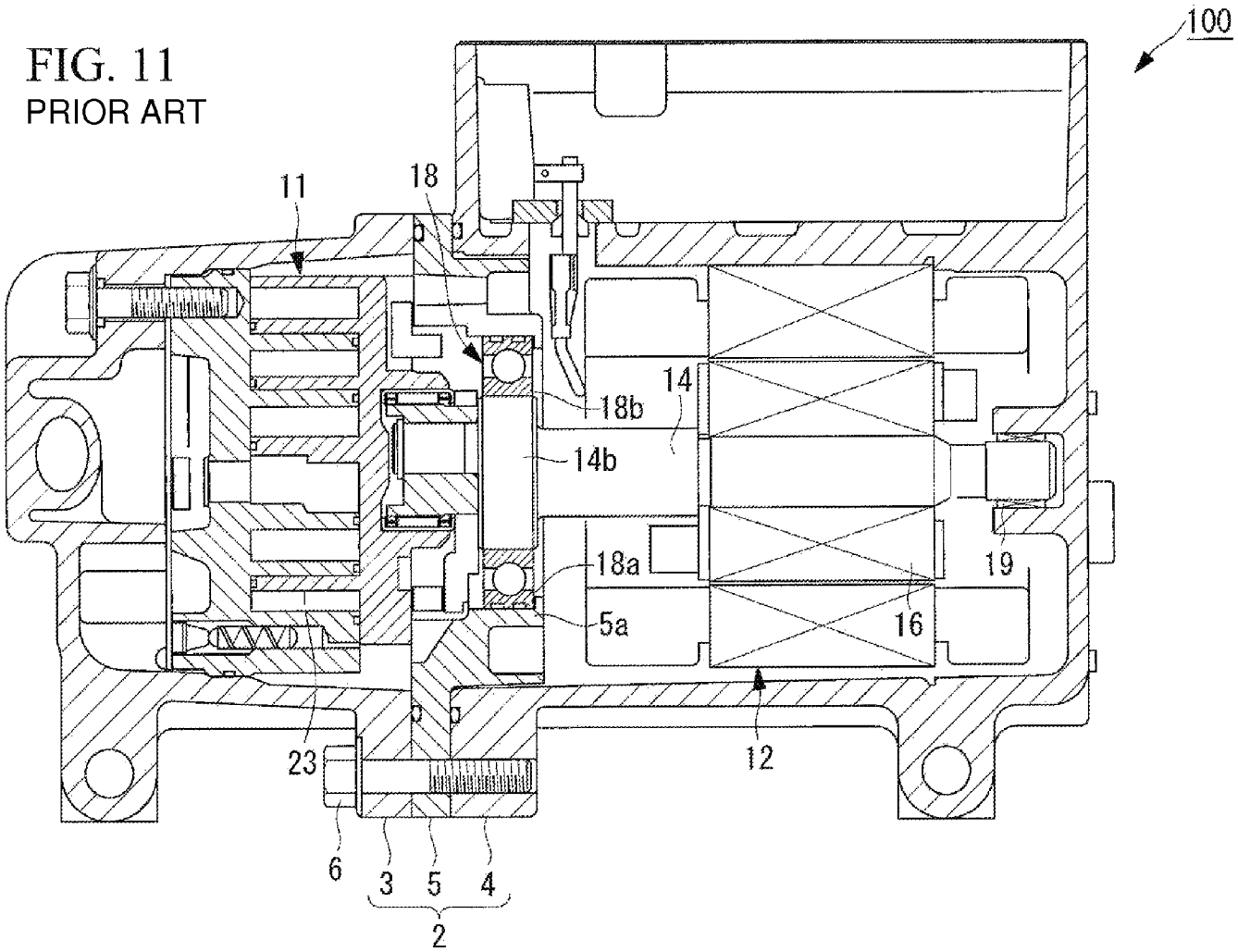
FIG. 11 PRIOR ART
FIG. 11 is a longitudinal sectional view for explaining, in outline, the structure of a conventional electric compressor that is mounted on a vehicle that travels by means of an internal-combustion engine.
Figure 12:
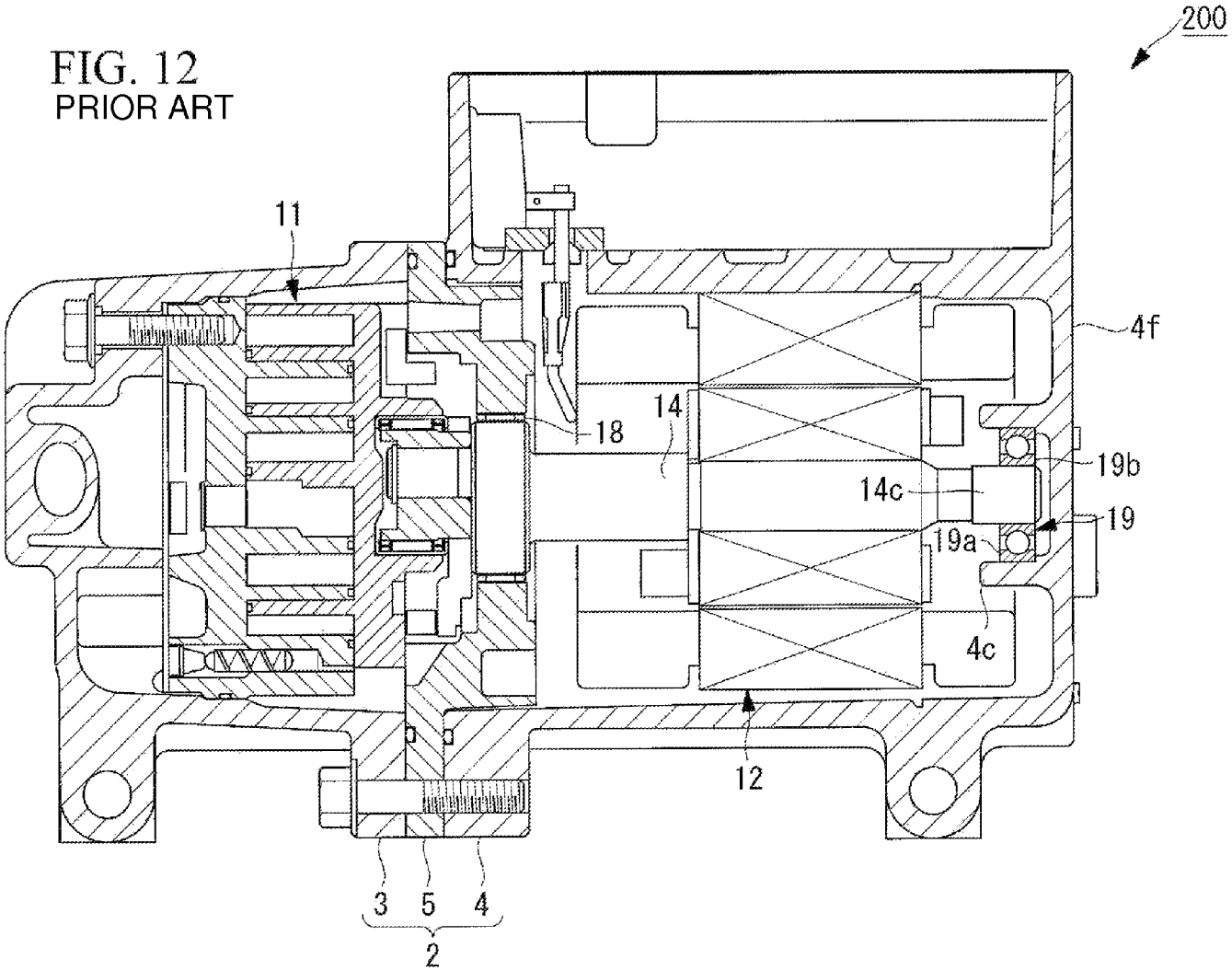
FIG. 12 PRIOR ART
FIG. 12 is a longitudinal sectional view for explaining, in outline, the structure of a conventional electric compressor that is mounted on a vehicle that travels by means of the power of an electric motor.

FIG. 7 is a longitudinal sectional view for explaining, in outline, the structure of the electric compressor of a fifth embodiment of the present invention. FIGS. 8 to 10 show a procedure for assembly of the electric compressor of this embodiment.

The aluminum alloy housing 2, forming the outer shell of the electric compressor 1, is constituted by the compression-mechanism housing 3 and the electric-motor housing 4. The compression-mechanism housing 3 and the electric-motor housing 4 are fixed, with the O-ring 28 interposed therebetween.

In the electric-motor housing 4, the through channel 40*a* that extends from the main shaft 14 toward the inverter box 7 in the radial direction of the main shaft (rotating shaft) 14 is provided near the end surface 40*f* of the electric-motor housing main body (housing main body) 40 where the cover 41 is provided. The glass terminal 26 is accommodated in the through channel 40*a*. Furthermore, the main-bearing bore part (intermediate bearing holding part) 40*b*, which supports the main bearing (bearing) 18, is provided integrally with the electric-motor housing main body 40 in the electric-motor housing main body 40 closer to the compression-mechanism housing 3.

Next, the assembly method for the electric compressor 1 of this embodiment will be described with reference to FIGS. 8 to 10.

First, in the shrink fitting process, the rotor 16 is shrink-fitted onto the rotor press-fitting portion 14*a* of the main shaft 14, as shown in the right drawing of FIG. 8. In the shrink fitting process, the rotor 16 is heated to make it expand, the main shaft 14 is cooled to make it shrink, the rotor press-fitting portion 14*a* of the main shaft 14 is inserted into the central hole (not shown) of the rotor 16, and then, these members 14 and 16 are both cooled, thus achieving the shrink fitting.

Next, assembly of the sub-bearing (rolling bearing) 19 and the sub-bearing holding member (end-side bearing holding part) 51 is performed. Specifically, in the press fitting process of the outer race (outer ring) 19*a* of the sub-bearing 19, the outer race 19*a* of the sub-bearing 19 is press-fitted into the sub-bearing bore part 51*c* of the sub-bearing holding member 51 by using a pressing machine or the like, so as not to be inclined. The outer race 19*a* press-fitted into the sub-bearing bore part 51*c* is positioned so as to be flush with the surface of the flange part 51*a* of the sub-bearing holding member 51 closer to the cover 41 (see FIG. 7).

Next, in the press fitting process of the inner race (inner ring) 19*b* of the sub-bearing 19, the sub-bearing journal part 14*c* of the main shaft 14 is press-fitted into the inner race 19*b* of the sub-bearing 19 attached to the sub-bearing bore part 51*c* of the sub-bearing holding member 51, from the scroll compression mechanism 11 side (see FIG. 7) by using a pressing machine or the like.

At this time, in order to apply a pressing force for press fitting only to the inner race 19*b*, the substantially-cylinder-shaped assembly jig (not shown) is used to support the inner race 19*b* from the cover 41 side. By using the assembly jig to support the inner race 19*b* from the cover 41 side, in this way, the position of the inner race 19*b* with respect to the sub-bearing journal part 14*c* of the main shaft 14 can be set so as to be flush with the surface of the flange part 51*a* closer to the cover 41, in the press fitting process of the inner race 19*b*.

Furthermore, simultaneously with the press fitting process of the sub-bearing 19, as shown in the left drawing of FIG. 8, the stator 15 is fixed to the inner periphery of the electric-motor housing main body 40, and the inverter box 7 is installed on the top of the electric-motor housing main body 40. Then, the glass terminal 26 is inserted into the through channel 40*a*, provided in the electric-motor housing main body 40.

Furthermore, the main bearing 18 is press-fitted into the main-bearing bore part 40*b*, provided in the electric-motor housing main body 40.

Next, the main shaft 14 and the sub-bearing holding member 51 from which the assembly jig is removed after the press fitting process of the inner race 19*b* is finished are inserted into the electric-motor housing main body 40. At this time, the main shaft 14 is inserted into the electric-motor housing main body 40 from the cover 41 side such that the sub-bearing bore part 51*c* of the sub-bearing holding member 51 connected to the main shaft 14 is accommodated in the electric-motor housing main body 40.

The main-bearing journal part 14*b* of the thus-inserted main shaft 14 is supported by the main bearing 18 press-fitted into the main-bearing bore part 40*b*, as shown in the lower drawing of FIG. 9. Furthermore, the main shaft 14 is supported by the main bearing 18, and the flange part 51*a* of the sub-bearing holding member 51 is embedded and accommodated in the concave portion 50 provided on the end surface 40*f* of the electric-motor housing main body 40 closer to the cover 41 (see FIG. 7).

Then, as shown in the upper drawing of FIG. 9, the cover 41 is fixed to the electric-motor housing main body 40 by a bolt (not shown) from the flange part 51*a* side of the sub-bearing holding member 51. At this time, the O-ring 44 is provided between the cover 41 and the flange part 51*a* to seal the gap between the cover 41 and the flange part 51*a*.

Next, as shown in the lower drawing of FIG. 10, the bushing 21 is placed onto the crank pin 14*d* provided on the main shaft 14, and the bushing 21 into which the crank pin 14*d* has been inserted is inserted into the bearing 22 (see FIG. 7) press-fitted into the orbiting scroll member 23 (see FIG. 7). Thus, the orbiting scroll member 23 and the main shaft 14 are coupled.

Furthermore, as shown in the upper drawing of FIG. 10, the fixed scroll member 24 accommodated and fixed in the compression-mechanism housing 3 near the base end of the compression-mechanism housing 3 is fitted into the orbiting scroll member 23 coupled with the main shaft 14, and the O-ring 28 is provided so as to be interposed between the compression-mechanism housing 3 and the electric-motor housing 4.

Then, the electric-motor housing 4 and the compression-mechanism housing 3 are fixed by the bolt 6, the inverter apparatus (not shown) is accommodated in the inverter box 7, and the inverter apparatus and the glass terminal 26 are connected, thereby completing the assembly of the electric compressor 1.

REFERENCE SIGNS LIST

1 electric compressor
2 housing
4*c* end-side bearing holding part (sub-bearing bore part)
4*e* opening (assembly-jig opening)
4*f* end surface (surface)
11 compression unit (scroll compression mechanism)
12 electric motor
14 main shaft (rotating shaft)
19 rolling bearing (sub-bearing)
19*a* outer ring (outer race)
19*b* inner ring (inner race)
40 housing main body (electric-motor housing main body)
41 cover

The invention claimed is:

1. An electric compressor comprising:

a compression unit that compresses a refrigerant;

an electric motor that is coupled with the compression unit via a rotating shaft;

a housing that has a cylinder-shaped housing main body for accommodating the compression unit and the electric motor and a cover for blocking an end surface of the housing main body;

an end-side bearing holding part that is provided independently from the housing main body and that is provided between the housing main body and the cover; and a rolling bearing that has an outer ring that is press-fitted into the end-side bearing holding part and an inner ring into which an end of the rotating shaft is press-fitted, wherein an opening is provided in a surface of the end-side bearing holding part facing the cover, wherein a tapered part is provided at a portion of an inner side of an inner wall of the opening in an axial direction of the housing, wherein a concave groove is provided at a portion of an outer side of the inner wall of the opening in the axial direction of the housing, wherein a blocking plate for blocking the opening is further provided in the opening, with a sealing member interposed therebetween, wherein the blocking plate has a shape in which three disk-shaped parts having different outer diameters are stacked each other, and the outer diameters of the three disk-shaped parts are reduced in a direction which extends from the end surface of the housing main body toward the inside of the housing and the block plate is provided in the opening, wherein the blocking plate has a corner formed by the disk-shaped part of the three disk-shaped parts having a smallest outer diameter and a disk-shaped part of the three disk-shaped parts having an intermediate diameter, and blocks the opening by providing the sealing member between the tapered part and the corner, and wherein a retaining ring is inserted between the concave groove and an outer circumference of a disk-shaped part of the three disk-shaped parts having a largest diameter on an outer side in the axial direction of the housing, and a movement of the blocking plate in the axial direction of the housing is limited by engaging the retaining ring with the concave groove in a case in which the block plate is provided in the opening.

2. The electric compressor according to claim 1, wherein the end surface of the housing main body closer to the cover has a concave portion that is depressed in a direction opposite to the cover; and the end-side bearing holding part is embedded in the concave portion.

3. The electric compressor according to claim 1, further comprising:

a second bearing that supports the rotating shaft disposed between the compression unit and the electric motor; and an intermediate bearing holding part that supports the second bearing, wherein the intermediate bearing holding part is provided integrally with the housing or the housing main body.

* * * * *